US008443895B2

(12) United States Patent
Harms

(10) Patent No.: US 8,443,895 B2
(45) Date of Patent: May 21, 2013

(54) TRAVEL JOINT HAVING AN INFINITE SLOT MECHANISM FOR SPACE OUT OPERATIONS IN A WELLBORE

(75) Inventor: Timothy Edward Harms, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

(21) Appl. No.: 13/028,885

(22) Filed: Feb. 16, 2011

(65) Prior Publication Data

US 2012/0205117 A1 Aug. 16, 2012

(51) Int. Cl.
*E21B 19/00* (2006.01)
*E21B 23/00* (2006.01)

(52) U.S. Cl.
USPC ..... 166/344; 166/339; 166/355; 166/85.5; 285/145.1; 285/302

(58) Field of Classification Search
USPC ..... 166/344, 338, 339, 341, 345, 351, 166/352, 355, 360, 378–380, 85.1, 85.5; 285/145.1, 298, 302
See application file for complete search history.

(56) References Cited

U.S. PATENT DOCUMENTS 3,054,454 A * 9/1962 Evans ..... 166/178
3,209,832 A * 10/1965 Tausch ..... 166/138
3,703,104 A * 11/1972 Tamplen ..... 74/88
4,321,965 A * 3/1982 Restarick et al. ..... 166/117.5
4,355,685 A * 10/1982 Beck ..... 166/240
4,519,451 A * 5/1985 Gray et al. ..... 166/278
4,781,250 A * 11/1988 McCormick et al. ..... 166/240
4,817,723 A * 4/1989 Ringgenberg ..... 166/321
5,095,979 A * 3/1992 Perricone ..... 166/138
5,823,264 A * 10/1998 Ringgenberg ..... 166/355
5,894,890 A * 4/1999 Garcia-Soule et al. ..... 166/356
6,131,663 A * 10/2000 Henley et al. ..... 166/373
6,257,339 B1 * 7/2001 Haugen et al. ..... 166/387
6,367,552 B1 * 4/2002 Scott et al. ..... 166/355
6,540,025 B2 * 4/2003 Scott et al. ..... 166/355
6,550,540 B2 * 4/2003 Trent ..... 166/382
6,557,637 B1 * 5/2003 Dore et al. ..... 166/338
6,948,561 B2 * 9/2005 Myron ..... 166/240
7,040,406 B2 * 5/2006 Dore et al. ..... 166/338
7,380,596 B2 * 6/2008 De Clute-Melancon .. 166/242.7
7,431,080 B2 * 10/2008 Wright et al. ..... 166/210
7,497,259 B2 * 3/2009 Leising et al. ..... 166/297
7,591,315 B2 * 9/2009 Dore et al. ..... 166/338

(Continued)

OTHER PUBLICATIONS

International Search Report and Written Opinion, PCT/US2012/022557, KIPO (Aug. 8, 2012).

*Primary Examiner* — Matthew Buck
(74) *Attorney, Agent, or Firm* — Lawrence R. Youst

(57) ABSTRACT

A travel joint (100) for space out operations in a wellbore. The travel joint (100) includes a generally tubular mandrel assembly (112) and a generally tubular housing assembly (102) slidably disposed about the mandrel assembly (112). The mandrel assembly (112) included an infinite slot (118) and at least one axial slot (120). A lock assembly (128) is positioned between the mandrel assembly (112) and the housing assembly (102). The lock assembly (128) is operable to selectively prevent and allow relative axial movement between the mandrel assembly (112) and the housing assembly (102). A floating lug ring (140) is positioned between the mandrel assembly (112) and the housing assembly (102). The floating lug ring (140) includes at least one lug (142) and is operable to rotate relative to the mandrel assembly (112) and the housing assembly (102) when the lug (142) travels in the infinite slot (118).

14 Claims, 8 Drawing Sheets

U.S. PATENT DOCUMENTS 7,918,279 B2 * 4/2011 Leising et al. ..... 166/297
8,011,434 B2 * 9/2011 Cosgrove et al. ..... 166/341
8,210,264 B2 * 7/2012 Mohr ..... 166/343
8,272,445 B2 * 9/2012 Fay ..... 166/373
8,286,717 B2 * 10/2012 Giroux et al. ..... 166/382
2002/0092653 A1 * 7/2002 Scott et al. ..... 166/338
2004/0007356 A1 * 1/2004 Myron ..... 166/240

* cited by examiner

TRAVEL JOINT HAVING AN INFINITE SLOT MECHANISM FOR SPACE OUT OPERATIONS IN A WELLBORE

TECHNICAL FIELD OF THE INVENTION

This invention relates, in general, to equipment utilized in conjunction with operations performed in subterranean wells and, in particular, to a travel joint having an infinite slot mechanism for space out operations in a wellbore.

BACKGROUND OF THE INVENTION

Without limiting the scope of the present invention, its background will be described in relation to subterranean well operations performed from floating platforms, as an example.

Drilling rigs supported by floating drill ships or floating platforms are often used for offshore well development. These rigs present a problem for the rig operators in that ocean waves and tidal forces cause the drilling rig to rise and fall with respect to the sea floor and the subterranean well. This vertical motion must be either controlled or compensated while operating the well. Without compensation, such vertical movement may transmit undesirable axial loads on the rigid tubular strings that extended downwardly from the drilling rig. This problem becomes particularly acute in well operations involving fixed bottom hole assemblies, such as packers.

For example, once a lower completion has been installed in a casing string or open hole location, it is common to stab the lower end of the upper completion, run into the well on a tubing string, into the packer at the top of the lower completion assembly. Typically, the connection operation requires that the tubing string apply a predetermined amount of axial and/or rotational force against the packer. Once connected, any vertical movement from the ship or platform will create undesirable downward and upward forces on the packer or may cause premature failure of components.

One way to reduce the undesirable downward and upward forces is to install a travel joint in the tubing string which allows for telescopic extension and contraction of the tubing string. Typically, the travel joint is run downhole in a locked position, then unlocked once the tubing string is connected to the packer. It has been found, however, that in certain wellbores such as highly deviated wellbores, a travel joint may prematurely unlock. For example, in deep water offshore drilling operations, it is routine to drill a number of wells from a single platform. Each well is directionally drilled to a target location in a zone of interest, which may be a lengthy horizontal distance from the platform. Therefore, significant force is sometimes required to push the tubing string as it slides along the inner wall of the casing string. This force may unlock the travel joint prior to stinging into the packer. Once unlocked, it is virtually impossible to sting into the packer without relocking the travel joint, which may require an additional trip out of the well to redress the travel joint.

In addition, it has been found, that there may be uncertainty relating to whether a premature unlocking has taken place. With certain prior art type travel joints, no accurate means is available for gauging whether the travel joint has become unlocked. Often, the first indication that the travel joint is in the unlocked position manifests itself when the tubing string will not sting into the packer. At that point, the entire tubing string may need to be removed from the wellbore, reset or redressed, and then run in again with the hope that the travel joint will not become unlocked.

Accordingly, a need has arisen for a travel joint operable to telescopically extend and contract the tubing string to compensate for vertical motion of a floating platform. A need has also arisen for such a travel joint that has a reliable locking and unlocking mechanism suitable for tubing string installations in highly deviated wells or wells having restrictions. Further, a need has arisen for such a travel joint that enables stabbing the tubing string into the packer even if the travel joint has become unlocked without the requirement of tripping the travel joint out of the well for resetting or redressing.

SUMMARY OF THE INVENTION

The present invention disclosed herein is directed to a travel joint operable to telescopically extend and contract a tubing string to compensate for vertical motion of a floating platform. In addition, the travel joint of the present invention has a reliable locking and unlocking mechanism suitable for tubing string installations in highly deviated wells or wells having restrictions. Further, the travel joint of the present invention enables stabbing a tubing string into a packer even if the travel joint has become unlocked without the requirement of tripping the travel joint out of the well for resetting or redressing.

In one aspect, the present invention is directed to a travel joint for space out operations in a wellbore. The travel joint includes a generally tubular mandrel assembly and a generally tubular housing assembly slidably disposed about the mandrel assembly. The mandrel assembly has an infinite slot and at least one axial slot. A lock assembly is positioned between the mandrel assembly and the housing assembly. The lock assembly is operable to selectively prevent and allow relative axial movement between the mandrel assembly and the housing assembly. A floating lug ring is positioned between the mandrel assembly and the housing assembly. The floating lug ring includes at least one lug and is operable to rotate relative to the mandrel assembly and the housing assembly when the lug travels in the infinite slot.

In one embodiment, the infinite slot includes a circumferentially repeating sequence of a ramp in the uphole direction, a leg in the uphole direction, a ramp in the downhole direction and a leg in the downhole direction. In certain embodiments, the circumferentially repeating sequence occurs four times about a circumference of the mandrel assembly. In some embodiments, the leg in the downhole direction is axially aligned with the axial slot. In these and other embodiments, in an unlocked configuration, the lug travels in the infinite slot responsive to sequential axial shifting of the housing assembly relative to the mandrel assembly in a first direction and a second direction.

In another embodiment, the lock assembly includes a snap ring that is operable to be propped in a channel of the mandrel assembly by a retainer ring that is operable to be pinned to the mandrel assembly. In the locked configuration, the snap ring prevents axial movement of the housing assembly relative to the mandrel assembly in a first direction and the pins prevent axial movement of the housing assembly relative to the mandrel assembly in a second direction until the pins are sheared by a predetermined axial force biasing the housing assembly relative to the mandrel assembly in the second direction.

In a further embodiment, the floating lug ring includes two lugs circumferentially positioned relative to each other at about 180 degree increments. In some embodiments, in an unlocked configuration, the lug of the floating lug ring is operable to travel in the axial slot enabling relative axial movement between the mandrel assembly and the housing assembly. In this and other embodiments, at least one key lug is positioned between the mandrel assembly and the housing assembly such that the key lug is operable to travel in the axial slot.

In another aspect, the present invention is directed to a travel joint for space out operations in a wellbore. The travel joint includes a generally tubular mandrel assembly and a generally tubular housing assembly slidably disposed about the mandrel assembly. The mandrel assembly has an infinite slot and at least one axial slot. A floating lug ring is positioned between the mandrel assembly and the housing assembly. The floating lug ring includes at least one lug and is operable to rotate relative to the mandrel assembly and the housing assembly when the lug travels in the infinite slot.

In a further aspect, the present invention is directed to a method for spacing out tubulars in a wellbore. The method includes positioning a travel joint in a tubular string, running the tubular string in the wellbore and coupling a downhole end of the tubular string with a fixed component in the wellbore, unlocking a generally tubular mandrel assembly of the travel joint from a generally tubular housing assembly of the travel joint that is slidably disposed about the mandrel assembly, operating the travel joint through multiple operating configurations by a sequentially axially shifting the housing assembly relative to the mandrel assembly in first and second directions and rotating a floating lug ring relative to the mandrel assembly and the housing assembly as at least one lug of the floating lug ring travels in an infinite slot of the mandrel assembly.

The method may also include rotating the floating lug ring as the at least one lug travels in a circumferentially repeating sequence of a ramp in the uphole direction, a leg in the uphole direction, a ramp in the downhole direction and a leg in the downhole direction, establishing a predetermined axial force biasing the housing assembly relative to the mandrel assembly in the second direction, shearing a plurality of pins coupling a retainer ring to the mandrel assembly, unpropping a snap ring from a channel in the mandrel assembly and axial shifting the housing assembly relative to the mandrel assembly while the lug of the floating lug ring is travelling in an axial slot of the mandrel assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
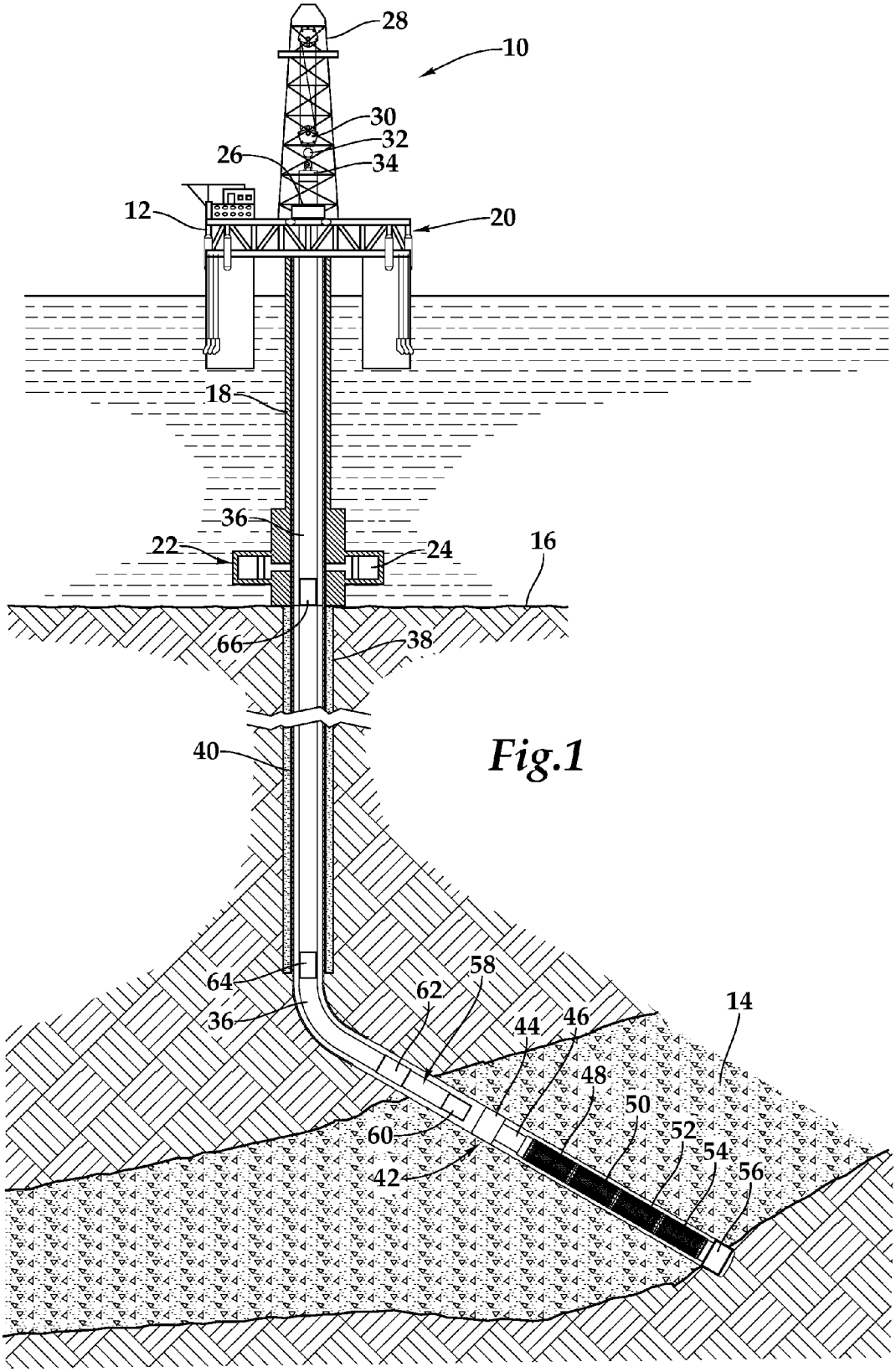
FIG. 1 is a schematic illustration of a floating offshore oil and gas platform installing a tubular string including a travel joint having an infinite slot mechanism according to an embodiment of the present invention.

Referring initially to FIG. 1, a travel joint having an infinite slot mechanism is positioned within a tubing string being deployed from an offshore oil or gas platform that is schematically illustrated and generally designated 10. A floating platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a tubing string 36.

A wellbore 38 extends through the various earth strata including formation 14. An upper portion of wellbore 38 includes casing 40 that is cemented within wellbore 38. Disposed in an open hole portion of wellbore is a lower completion 42 that includes various tools such as packer 44, a seal bore assembly 46 and sand control screen assemblies 48, 50, 52, 54 and sump packer 56. Disposed in wellbore 38 near the lower end of tubing string 36 is an upper completion 58 that includes various tools such as a production seal and latch assembly 60, a travel joint 62 and a production packer 64. In addition, a tubing string 36 includes a subsea tubing hanger 66. Travel joint 62 is operable to telescopically extend and contract tubing string 36 to compensate for vertical motion of platform 12 once tubing string 36 has been connected to packer 44 of upper completion 42 to enable subsea tubing hanger 66 to latch in and seal off at sea floor 16 and production packer 64 to be set. In addition, travel joint 62 has a reliable locking and unlocking mechanism operable for use in highly deviated wells such as wellbore 38. Further, travel joint 62 enables stabbing of tubing string 36 into packer 44 even if travel joint 62 has become unlocked without the requirement of tripping travel joint 62 out of well 38 for resetting or redressing.

Even though FIG. 1 depicts a slanted wellbore, it should be understood by those skilled in the art that the travel joint according to the present invention is equally well suited for use in wellbore having other orientations including vertical wellbores, horizontal wellbores, multilateral wellbores or the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be understood by those skilled in the travel joint according to the present invention is equally well suited for use in onshore operations. Further, even though FIG. 1 depicts an open hole completion, it should be understood by those skilled in the art that the travel joint according to the present invention is equally well suited for use in cased hole completions.

Figure 2A:
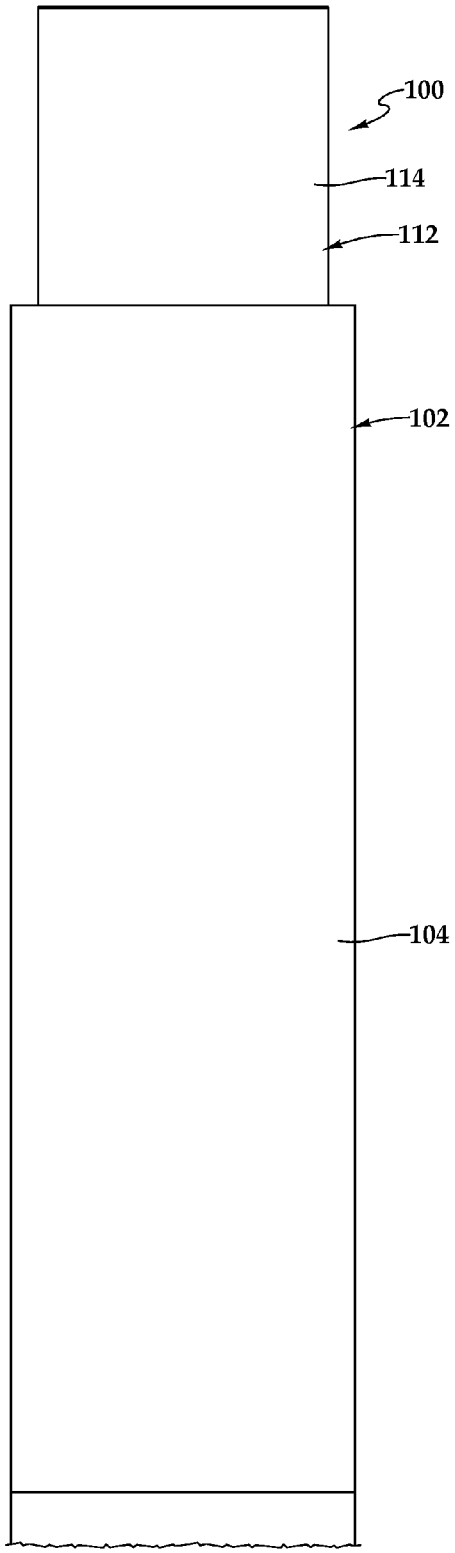
FIGS. 2A-2C are side elevation views of consecutive axial sections of a travel joint having an infinite slot mechanism according to an embodiment of the present invention.
Figure 3A:
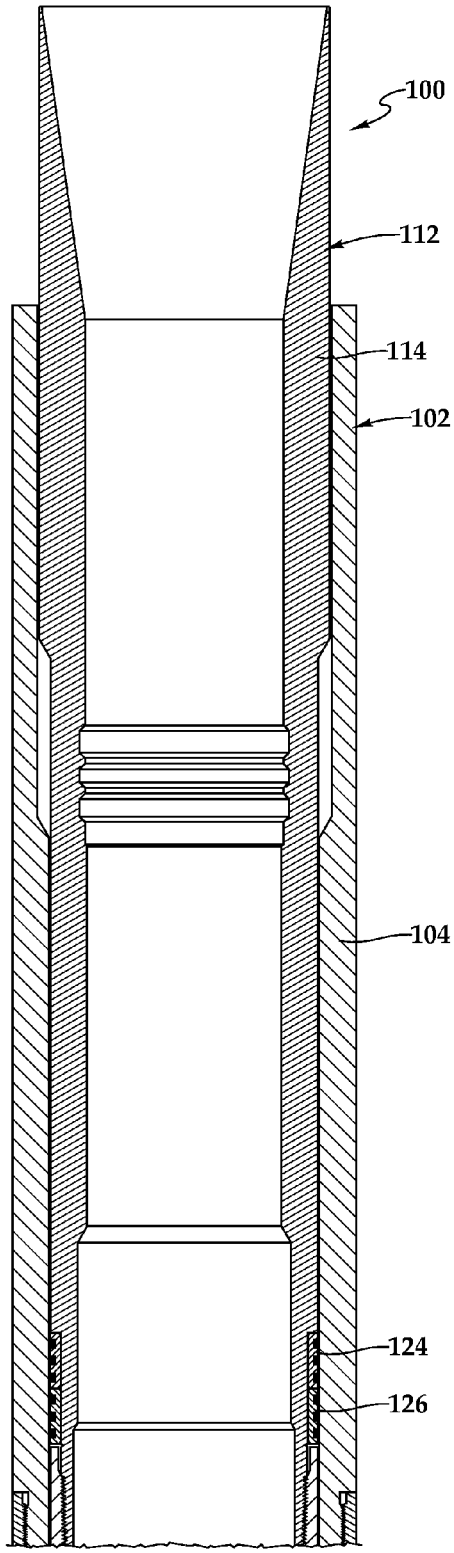
FIGS. 3A-3C are cross sectional views of consecutive axial sections of a travel joint having an infinite slot mechanism according to an embodiment of the present invention.
Figure 2B:
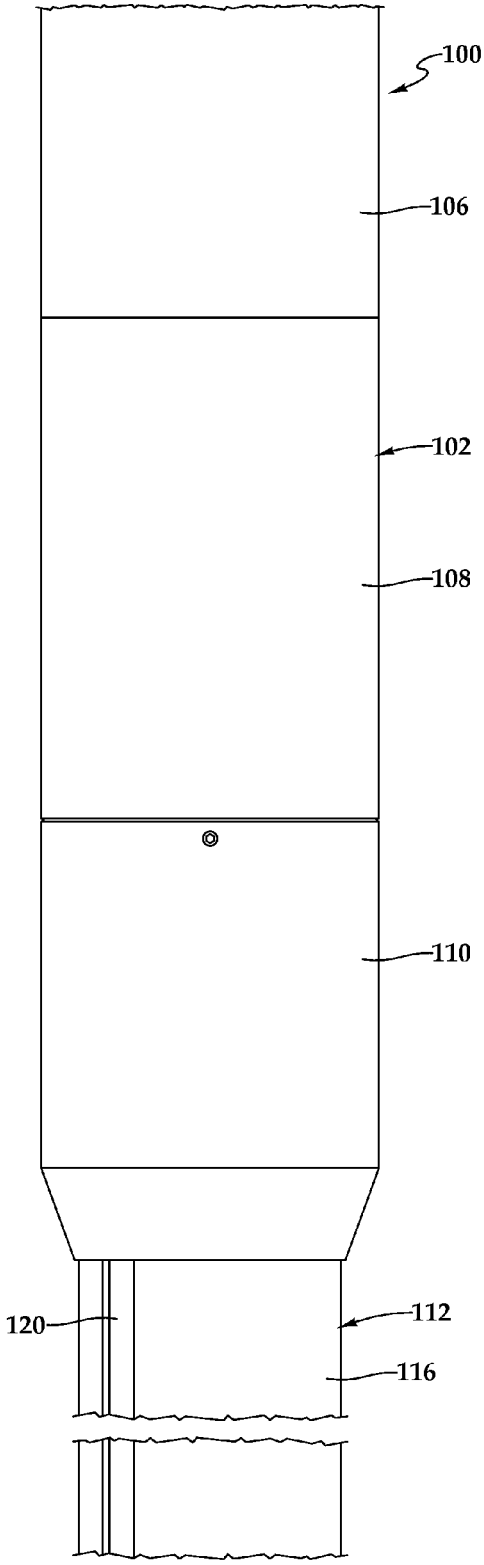
Figure 3B:
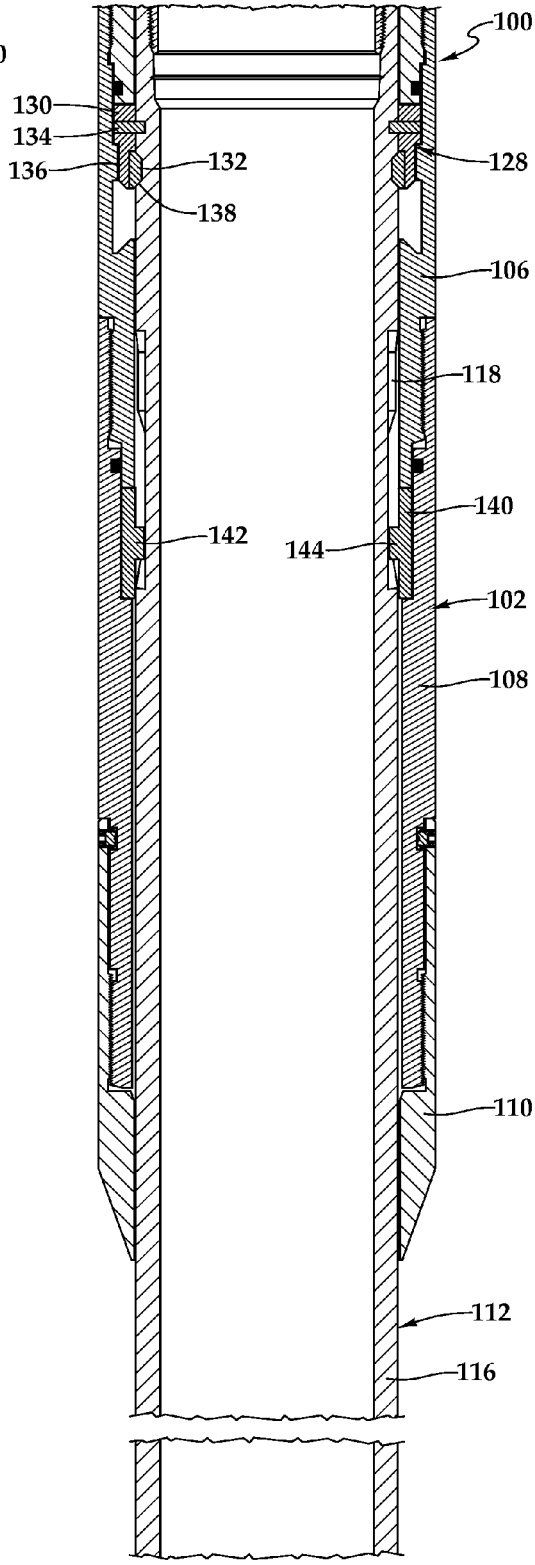
Figure 2C:
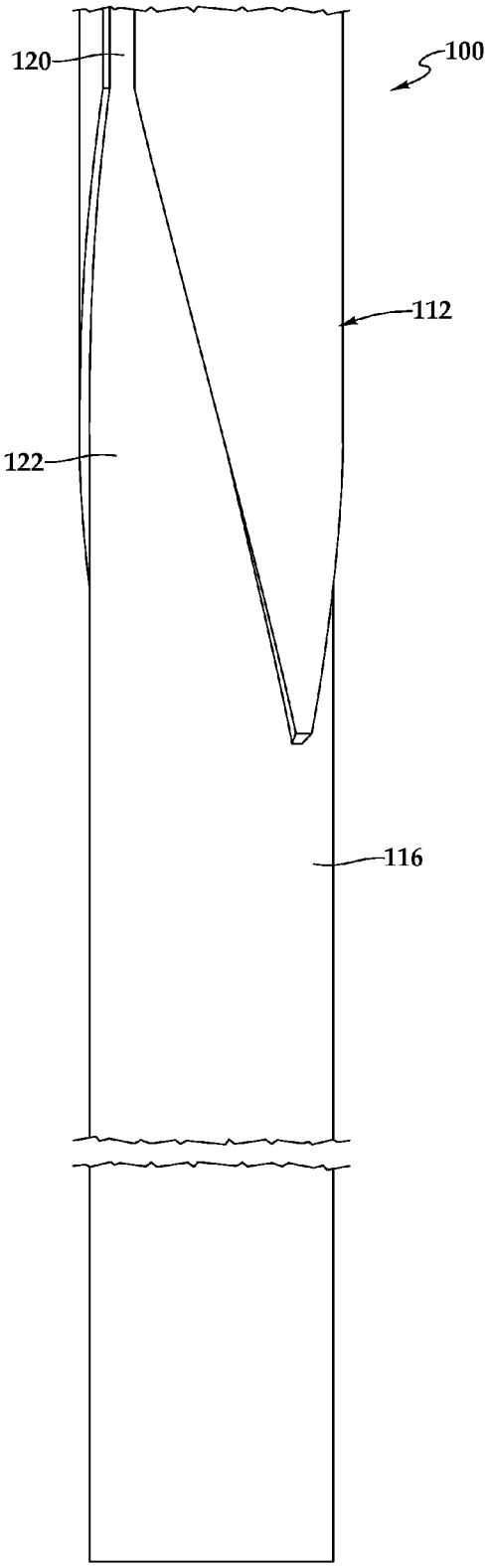
Figure 3C:
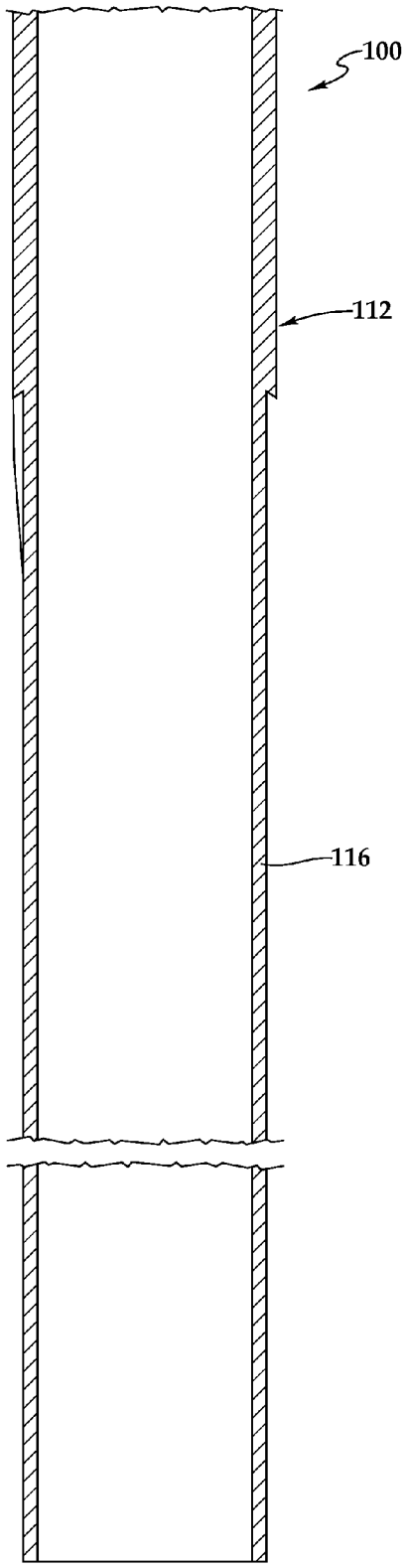

Referring now to FIGS. 2 and 3, including FIGS. 2A-2C and FIGS. 3A-3C, therein is depicted successive axial sections of a travel joint having an infinite slot mechanism that is generally designated 100. As discussed above, travel joint 100 is preferably positioned within a tubing string such that an upper portion of the tubing string extends above travel joint 100 and a lower portion of the tubing string extends below travel joint 100. The first several joints of the lower portion of the tubing string may be connected by means of flush joint internal threads in order to be easily received within travel joint 100. In addition, the first several joint of the lower portion of the tubing string may be precision machined joints such that repeated telescoping within the body of travel joint 100 will not damaging the inner wall, seals or operating mechanisms of travel joint 100.

Travel joint 100 includes a housing assembly 102, which is operably coupled to an upper portion of the tubing string (not pictured). In the illustrated embodiment, housing assembly 102 includes an upper housing 104, a lock assembly housing 106, a lug ring housing 108 and a lower housing 110. Even though housing assembly 102 has been depicted and described as having a particular number of housing members, those skilled in the art will recognize that other numbers of housing members both greater than and less than that shown are possible and are considered within the scope of the present invention.

Travel joint 100 includes a mandrel assembly 112, which is operably coupled to a lower portion of the tubing string (not pictured). In the illustrated embodiment, mandrel assembly 112 includes an upper mandrel 114 and a slotted mandrel 116. Even though mandrel assembly 112 has been depicted and described as having a particular number of mandrel members, those skilled in the art will recognize that other numbers of mandrel members both greater than and less than that shown are possible and are considered within the scope of the present invention. As explained in greater detail below, slotted mandrel 116 includes an infinite slot 118 and a pair of axial slots 120 including guide sections 122.

As best seen in FIG. 3A, a pair of packing assemblies 124, 126 is positioned between upper mandrel 114 and slotted mandrel 116. Packing assemblies 124, 126 provide a fluid seal between upper mandrel 114 and upper housing 104. As best seen in FIG. 3B, housing assembly 102 and mandrel assembly 112 are initially coupled together by a lock assembly 128. In the illustrated embodiment, lock assembly 128 includes a retainer ring 130, a snap ring 132 and a plurality of pins 134. Retainer ring 130 is positioned between a radially reduced portion 136 of lock assembly housing 106 and upper housing 104. Retainer ring 130 props snap ring 132, which is radially outwardly biased, in a circumferential channel 138 of slotted mandrel 116. Snap ring 132 initially prevents downward axial movement of housing assembly 102 relative to mandrel assembly 112. Pins 134 extend through retainer ring 130 into slotted mandrel 116. Pins 134 initially prevent upward axial movement of housing assembly 102 relative to mandrel assembly 112 until sufficient upward force is applied to cause pins 134 to shear, as explained in greater detail below. Even though a particular lock assembly has been depicted and described, one of ordinary skill in the art would understand that other types of lock assemblies could alternatively be used in association with travel joint 100, including, but not limited to, a collet assembly, wherein the collets could be supported and unsupported in a manner similar to snap ring 132.

As best seen in FIG. 3B, a floating lug ring 140 including a pair of lugs 142, 144 is positioned between lug ring housing 108 and slotted mandrel 116. Floating lug ring 140 is not physically connected to lock assembly housing 106, lug ring housing 108 or slotted mandrel 116. This allows floating lug ring 140 to rotate relative to lug ring housing 108 and rotate relative to slotted mandrel 116 as lugs 142, 144 travel within infinite slot 118, as explained in greater detail below. Even though floating lug ring 140 has been depicted and described as having a particular number of lugs, those skilled in the art will recognize that other numbers of lugs both greater than and less than that shown are possible and are considered within the scope of the present invention so long as the number of lugs is no greater than and preferably the same as the number of axial slots 120. A pair of key lugs (not visible in FIG. 3B) is positioned between a lower portion of lug ring housing 108 and slotted mandrel 106. The key lugs are operable to travel within respective axial slots 120, as explained in greater detail below. Even though a particular number of key lugs has been described, those skilled in the art will recognize that other numbers of key lugs both greater than and less than that described are possible and are considered within the scope of the present invention so long as the number of key lugs is no greater than and preferably the same as the number of axial slots 120.

Figure 4A:
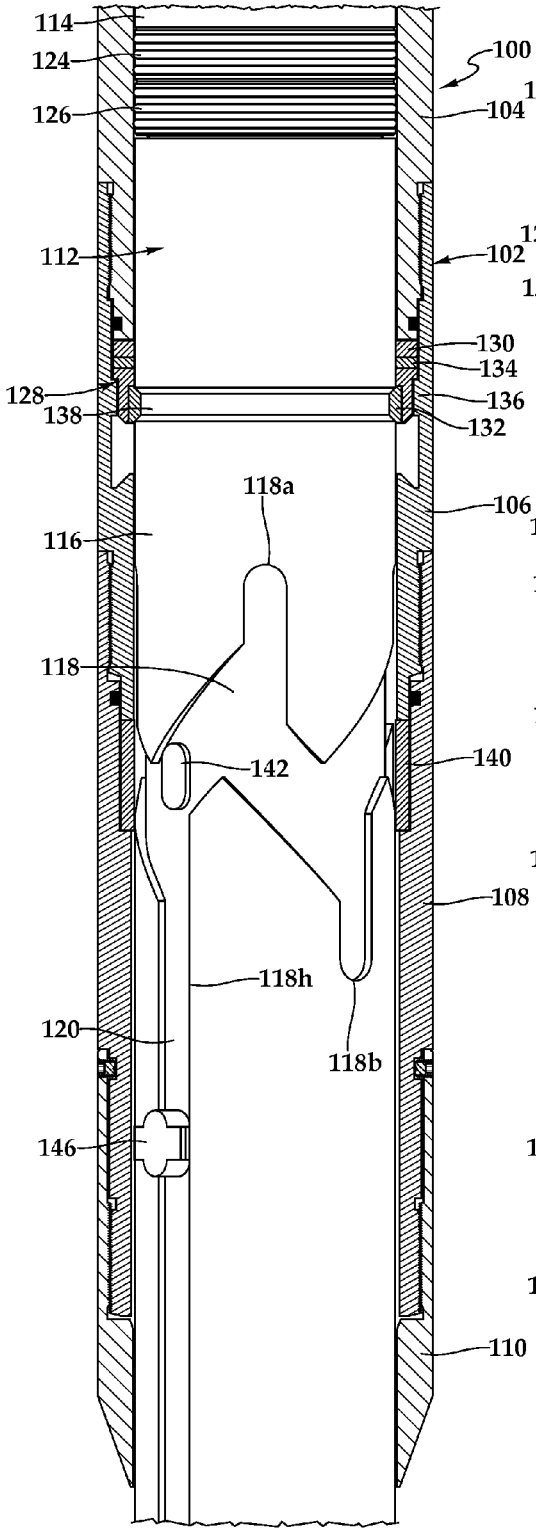
FIGS. 4A-4H are side elevation views, partially in cross section, of a travel joint having an infinite slot mechanism according to an embodiment of the present invention in various operating configurations.

Referring next to FIGS. 4A-4H, therein are depicted travel joint 100 in various operating configurations. In FIG. 4A, travel joint 100 is in its running and locked position. As illustrated, housing assembly 102 and mandrel assembly 112 are locked together by lock assembly 128. Specifically, retainer ring 130 props snap ring 132 in circumferential channel 138 of slotted mandrel 116. In addition, pins 134 extend through retainer ring 130 into slotted mandrel 116. In this configuration, snap ring 132 prevents downward axial movement of housing assembly 102 relative to mandrel assembly 112 and pins 134 prevent upward axial movement of housing assembly 102 relative to mandrel assembly 112.

Also seen in FIG. 4A is floating lug ring 140 and lug 142. It is noted that lugs 142, 144 are integral with or securably attached or associated with floating lug ring 140. For convenience of illustration and explanation, however, FIGS. 4A-4H show lug 142 discrete from floating lug ring 140 as lug 142 travels in infinite slot 118 and axial slots 120. Specifically, once travel joint 100 has been unlocked, as explained in greater detail below, lugs 142, 144 (only lug 142 being visible in FIGS. 4A-4H) are operable to travel in a circumferentially repeating sequence of a ramp in the uphole direction, a leg in the uphole direction, a ramp in the downhole direction and a leg in the downhole direction.

Figure 4B:
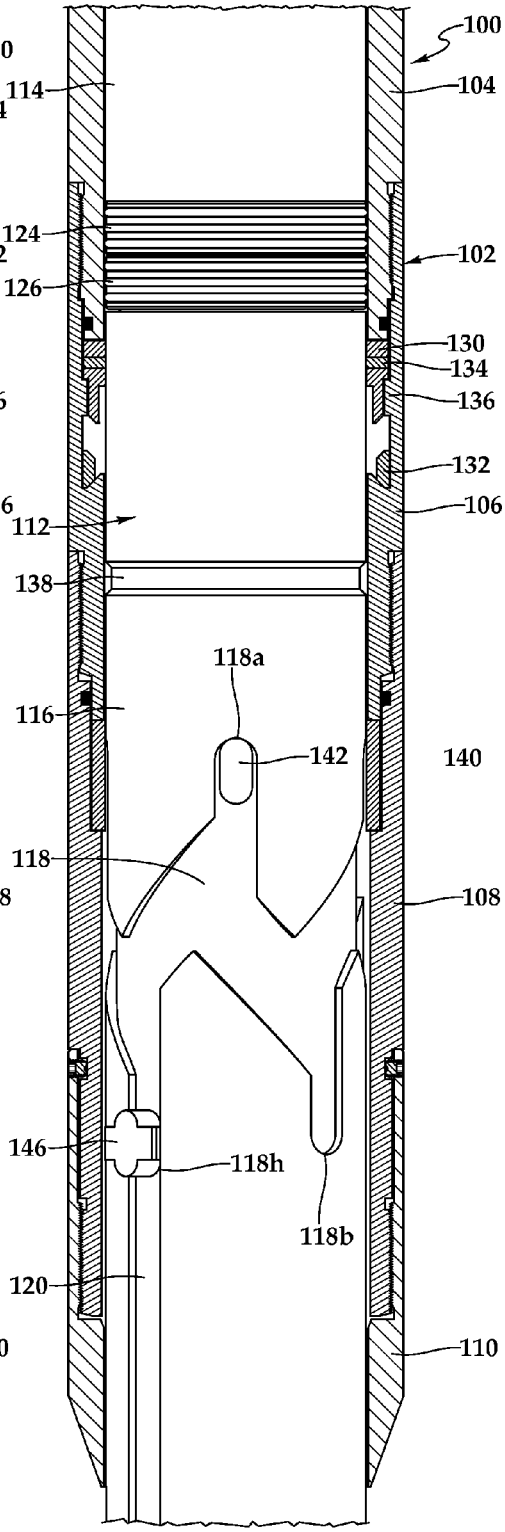

For example, starting with the view in FIG. 4A, when housing assembly 102 is moved upwardly relative to mandrel assembly 112, lug 142 will move up the ramp in the uphole direction and into the leg in the uphole direction, the upper portion of which is designated 118*a* (see FIG. 4B). As lug 142 moves up the ramp, floating lug ring 140 rotates relative to lug ring housing 108 and slotted mandrel 116. Thereafter, when housing assembly 102 is moved downwardly relative to mandrel assembly 112, lug 142 will exit the upwardly directed leg, move down the ramp in the downhole direction and into the leg in the downhole direction, the lower portion of which is designated 118*b* (see FIG. 4C). As lug 142 moves down the ramp, floating lug ring 140 rotates relative to lug ring housing 108 and slotted mandrel 116. Reciprocation of housing assembly 102 relative to mandrel assembly 112 in this manner will cause lug 142 to advance through locations 118*c* (see FIG. 4D), 118*d* (see FIG. 4E), 118*e* (see FIG. 4F), 118*f* (not pictured), 118*g* (not pictured) and 118*h* (not pictured) before beginning the sequence again at 118*a* (see FIG. 4B), which creates the infinitely repeating circumferential slot referred to herein as infinite slot 118 of slotted mandrel 116. It should be noted that two of the legs in the downhole direction designated at 118*d* and 118*h* coincide with upper portions of respective axial slots 120 (see FIGS. 4B and 4E).

Returning now to FIG. 4A, key lug 146 is depicted in one of the axial slots 120. Similar to lugs 142, 144 and floating lug ring 140, key lugs 146, 148 are integral with or securably attached or associated with lug ring housing 108. For convenience of illustration and explanation, however, FIGS. 4A-4H show key lugs 146, 148 discrete from lug ring housing 108 as key lugs 146, 148 travel in axial slots 120.

In FIG. 4B, travel joint 100 has been shifted to an unlocked position. As illustrated, housing assembly 102 and mandrel assembly 112 are no longer locked together by lock assembly 128. Specifically, once a tubing string including travel joint 100 has been coupled to a packer of a completion assembly or other fixed component in the wellbore, upward force applied to housing assembly 102 relative to mandrel assembly 112 acts on pins 134 until a predetermined force is reached causing pins 134 to shear. In the illustrated embodiment, the upward force is generated by raising the travel block which moves the upper portion of the tubing string in the uphole direction. In other embodiments, the force required to break pins 134 may be generated hydraulically, for example, by pressuring up the tubing string, pressuring up the annulus or the like to operate on a piston within a travel joint to break pins or otherwise release a lock assembly. Regardless of the means by which pins 134 are sheared, once the connection between retainer ring 130 and slotted mandrel 116 is severed, retainer ring 130 is able to move upwardly relative to snap ring 132 such that snap ring 132 becomes unpropped. As snap ring 134 is radially outwardly biased, snap ring 134 releases from channel 138 and enters a radially expanded portion of lock assembly housing 106. In this configuration, travel joint 100 is unlocked such that housing assembly 102 is free to move axially relative to mandrel assembly 112.

As seen in FIG. 4B, the extent of the upward travel of housing assembly 102 relative to mandrel assembly 112 is limited by contact between lugs 142, 144 and upper portions 118*a*, 118*e* of infinite slot 118 (only lug 142 and upper portion 118*a* being visible in FIG. 4B). This limited axial movement of housing assembly 102 relative to mandrel assembly 112 provides for controlled breaking of pins 134 and a predictable response within the wellbore following the breaking of pins 134. As noted above, while floating lug ring 140 is generally axially fixed between lock assembly housing 106 and lug ring housing 108, floating lug ring 140 is not physically connected to either lug ring housing 108 or slotted mandrel 116, which enables floating lug ring 140 to rotate relative to lug ring housing 108 and slotted mandrel 116 as lugs 142, 144 travel within infinite slot 118. Also as seen in FIG. 4B, key lug 146 is depicted in an upper portion of one of the axial slots 120.

Figure 4C:
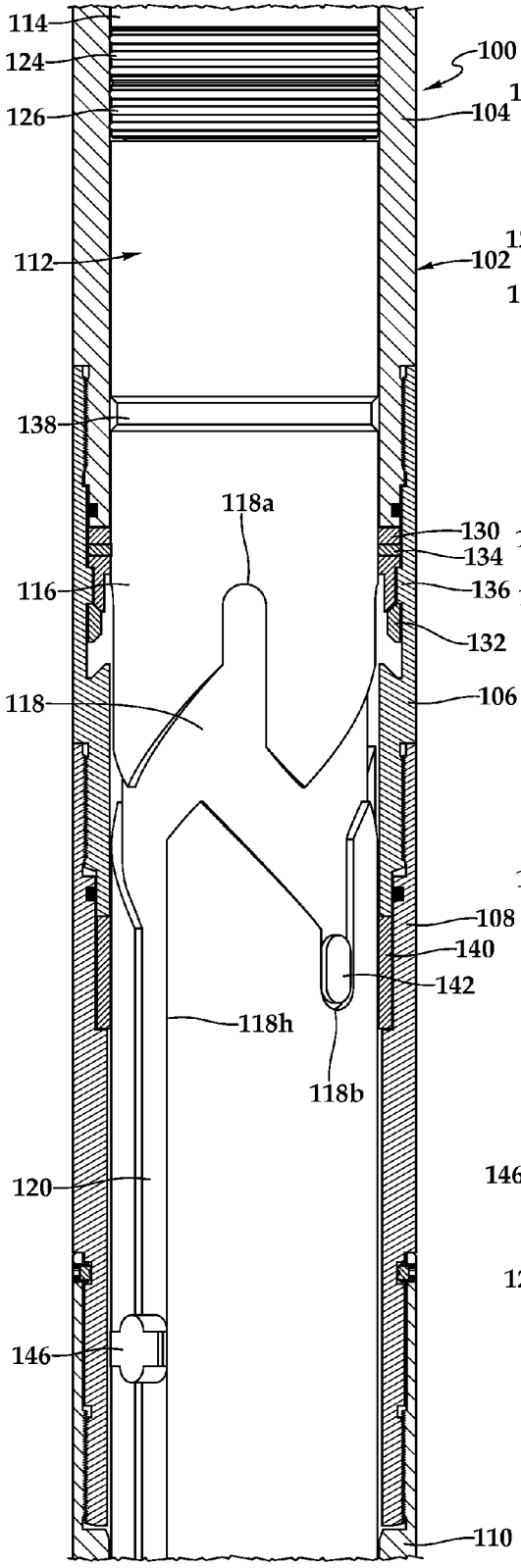

As seen in FIG. 4C, housing assembly 102 has moved downwardly relative to mandrel assembly 112 into a set down position. The extent of the downward travel of housing assembly 102 relative to mandrel assembly 112 is limited by contact between lugs 142, 144 and lower portions 118*b*, 118*f* of infinite slot 118 (only lug 142 and lower portion 118*b* being visible in FIG. 4C). This limited axial movement of housing assembly 102 relative to mandrel assembly 112 provides positive feedback to the operator regarding the position and progression of lugs 142, 144 within infinite slot 118. In addition, in the event of a premature unlocking, the position shown in FIG. 4C is operable to allow a tubing string including travel joint 100 has been coupled to a packer of a completion assembly or other fixed component in the wellbore. Also as seen in FIG. 4C, key lug 146 is depicted in one of the axial slots 120.

Figure 4D:
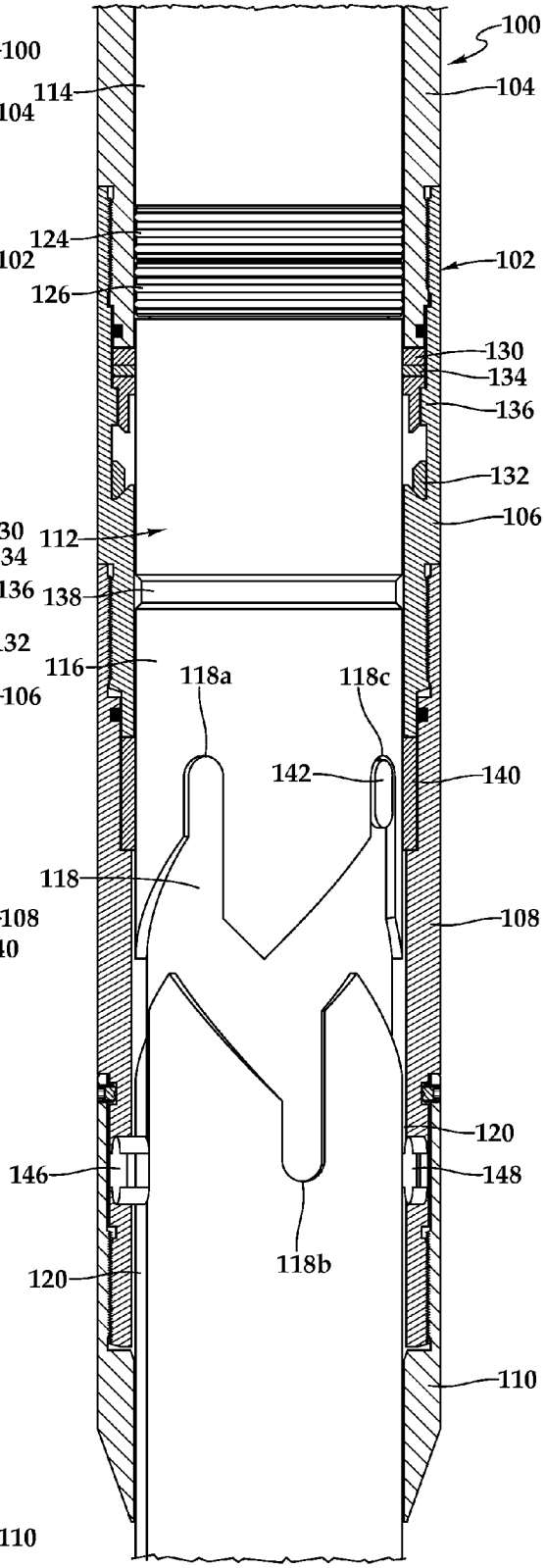

As seen in FIG. 4D, housing assembly 102 has moved upwardly relative to mandrel assembly 112 into a pickup position. The extent of the upward travel of housing assembly 102 relative to mandrel assembly 112 is limited by contact between lugs 142, 144 and upper portions 118*c*, 118*g* of infinite slot 118 (only lug 142 and upper portion 118*c* being visible in FIG. 4D). This limited axial movement of housing assembly 102 relative to mandrel assembly 112 provides positive feedback to the operator regarding the position and progression of lugs 142, 144 within infinite slot 118. Also as seen in FIG. 4D, key lugs 146, 148 are each depicted in an upper portion of a respective one of the axial slots 120.

Figure 4E:
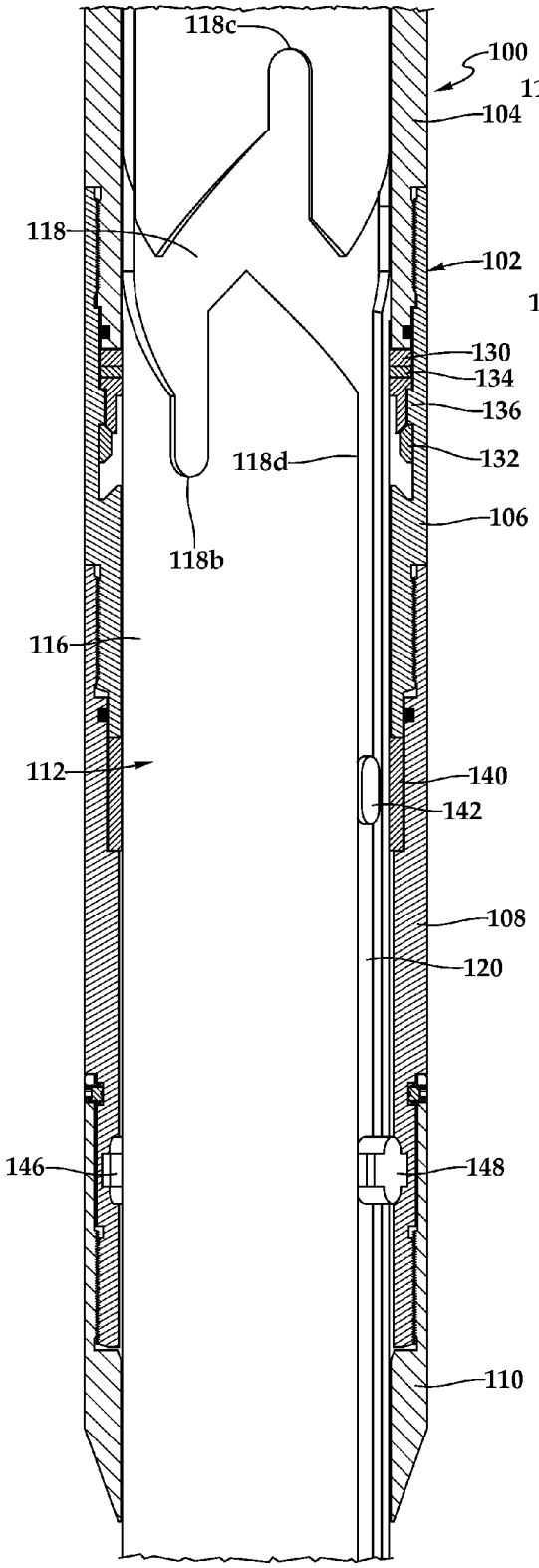

As seen in FIG. 4E, housing assembly 102 has moved downwardly relative to mandrel assembly 112 into a set down position. The extent of the downward travel of housing assembly 102 relative to mandrel assembly 112 is not limited by contact between lugs 142, 144 and lower portions 118*d*, 118*h* of infinite slot 118 (only lug 142 and lower portion 118*d* being visible in FIG. 4E) as lower portions 118*d*, 118*h* each align with an upper portion of a respective one of the axial slots 120. This unlimited axial movement of housing assembly 102 relative to mandrel assembly 112 provides positive feedback to the operator regarding the position and progression of lugs 142, 144 within infinite slot 118. Also as seen in FIG. 4E, key lugs 146, 148 are each depicted traveling downwardly in a respective one of the axial slots 120.

Figure 4F:
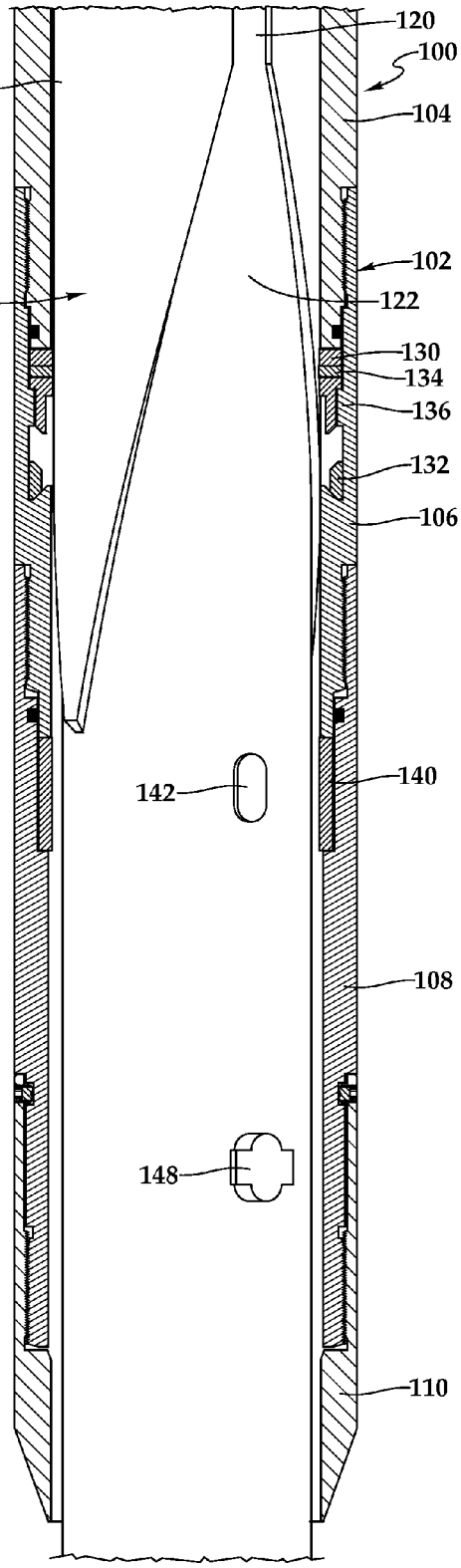

As seen in FIG. 4F, housing assembly 102 has moved further downwardly relative to mandrel assembly 112 into a telescoping position. Key lugs 146, 148 and lugs 142, 144 have exited the lower end of respective ones of the axial slots 120 (only lug 142 and key lug 148 being visible in FIG. 4F). In this configuration, housing assembly 102 is free to slide axially about mandrel assembly 112 as well as the lower portion of the tubing string to obtain proper space out. This telescopic movement of travel joint 100 can be repeated as needed to extend and contract the length of the tubing string to compensate for vertical motion of a floating platform.

Figure 4G:
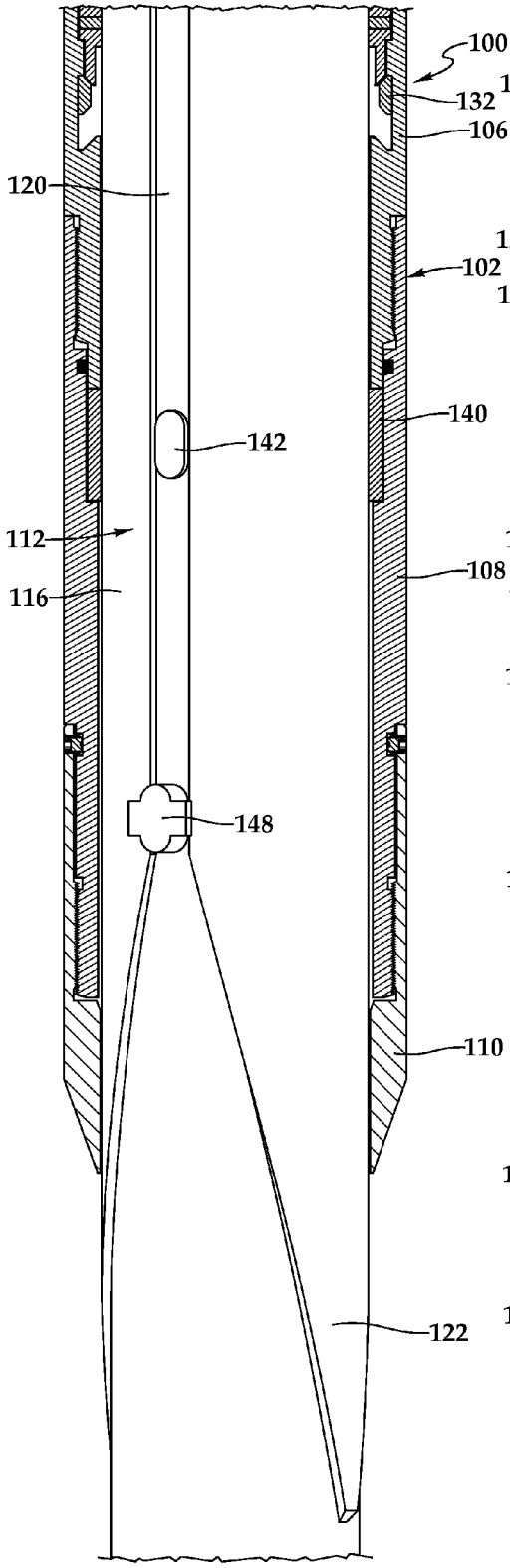
Figure 4H:
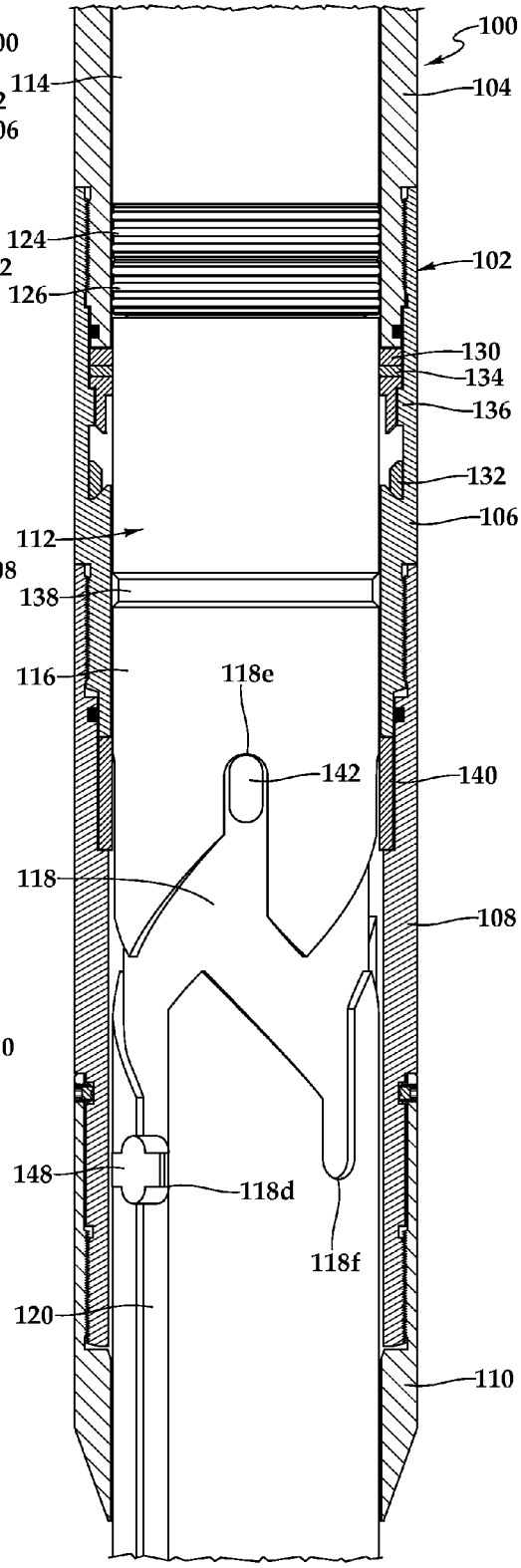

If desired, travel joint 100 can be shifted out of telescoping position. As seen in FIG. 4G, housing assembly 102 has moved upwardly relative to mandrel assembly 112 into a pickup position. Lugs 142, 144 and key lugs 146, 148 and entered a respective one of the axial slots 120 after passing through a respective one of the guide sections 122 (only lug 142 and key lug 148 being visible in FIG. 4G). Further upward movement of housing assembly 102 relative to mandrel assembly 112 resets travel joint 100, as best seen in FIG. 4H, wherein the upward travel of housing assembly 102 relative to mandrel assembly 112 is limited by contact between lugs 142, 144 and upper portions 118*a*, 118*e* of infinite slot 118 (only lug 142 and upper portion 118*e* being visible in FIG. 4H). In this configuration, continued upward force on travel joint 100 could be used to retrieve the tubing string from the wellbore or travel joint 100 can be cycled back into telescoping position, as described above, if desired.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A travel joint for space out operations in a wellbore, the travel joint comprising:

a generally tubular mandrel assembly including an infinite slot and at least one axial slot;

a generally tubular housing assembly slidably disposed about the mandrel assembly;

a lock assembly positioned between the mandrel assembly and the housing assembly, the lock assembly having a locked configuration wherein relative axial movement between the mandrel assembly and the housing assembly is prevented in a first axial direction and in a second axial direction that is opposite the first axial direction and an unlocked configuration wherein relative axial movement between the mandrel assembly and the housing assembly is allowed; and a floating lug ring positioned between the mandrel assembly and the housing assembly and including at least one lug, the floating lug ring operable to rotate relative to the mandrel assembly and the housing assembly when the lug travels in the infinite slot.

2. The travel joint as recited in claim 1 wherein the infinite slot further comprises a circumferentially repeating sequence of a ramp in the uphole direction, a leg in the uphole direction, a ramp in the downhole direction and a leg in the downhole direction.

3. The travel joint as recited in claim 2 wherein the leg in the downhole direction is axially aligned with the axial slot.

4. The travel joint as recited in claim 2 wherein the circumferentially repeating sequence occurs four times about a circumference of the mandrel assembly.

5. The travel joint as recited in claim 1 wherein, in the locked configuration, the lock assembly further comprises a snap ring propped in a channel of the mandrel assembly by a retainer ring that is pinned to the mandrel assembly.

6. The travel joint as recited in claim 5 wherein, in the locked configuration, the snap ring prevents axial movement of the housing assembly relative to the mandrel assembly in the first axial direction and the pins prevent axial movement of the housing assembly relative to the mandrel assembly in the second axial direction until the pins are sheared by a predetermined axial force biasing the housing assembly relative to the mandrel assembly in the second direction.

7. The travel joint as recited in claim 1 wherein the floating lug ring further comprises two lugs circumferentially positioned relative to each other at about 180 degree increments.

8. The travel joint as recited in claim 1 wherein, in the unlocked configuration, the lug of the floating lug ring is operable to travel in the axial slot enabling relative axial movement between the mandrel assembly and the housing assembly.

9. The travel joint as recited in claim 1 further comprising at least one key lug positioned between the mandrel assembly and the housing assembly, the key lug positioned in and operable to travel in the axial slot.

10. The travel joint as recited in claim 1 wherein, in the unlocked configuration, the lug travels in the infinite slot responsive to sequential axial shifting of the housing assembly relative to the mandrel assembly in the first axial direction and the second axial direction.

11. A method for spacing out tubulars in a wellbore, the method comprising:

positioning a travel joint in a tubular string;

running the tubular string in the wellbore and coupling a portion of the tubular string with a fixed component in the wellbore;

shifting the travel joint from a locked configuration wherein relative axial movement between a generally tubular mandrel assembly and a generally tubular housing assembly is prevented in a first axial direction and in a second axial direction that is opposite the first axial direction to an unlocked configuration wherein relative axial movement between the mandrel assembly and the housing assembly is allowed;

operating the travel joint through multiple operating configurations by sequentially axially shifting the housing assembly relative to the mandrel assembly in the first and second axial directions; and rotating a floating lug ring relative to the mandrel assembly and the housing assembly as at least one lug of the floating lug ring travels in an infinite slot of the mandrel assembly.

12. The method as recited in claim 11 wherein rotating the floating lug ring relative to the mandrel assembly and the housing assembly as the at least one lug of the floating lug ring travels in the infinite slot of the mandrel assembly further comprises rotating the floating lug ring as the at least one lug travels in a circumferentially repeating sequence of a ramp in the uphole direction, a leg in the uphole direction, a ramp in the downhole direction and a leg in the downhole direction.

13. The method as recited in claim 11 wherein shifting the travel joint from the locked configuration to the unlocked configuration further comprises:

establishing a predetermined axial force biasing the housing assembly relative to the mandrel assembly in the second direction;

shearing a plurality of pins coupling a retainer ring to the mandrel assembly; and unpropping a snap ring from a channel in the mandrel assembly.

14. The method as recited in claim 11 further comprising axial shifting the housing assembly relative to the mandrel assembly while the lug of the floating lug ring is travelling in an axial slot of the mandrel assembly.

* * * * *